US011493282B2

(12) United States Patent
Blokhin et al.

(10) Patent No.: US 11,493,282 B2
(45) Date of Patent: Nov. 8, 2022

(54) SHELL AND TUBE CONDENSER AND THE HEAT EXCHANGE TUBE OF A SHELL AND TUBE CONDENSER (VARIANTS)

(71) Applicant: Obshestvo S Ogranichennoi Otvetstvennost'u "Reinnolts Lab", Moscow (RU)

(72) Inventors: Pavel Alexandrovich Blokhin, Ekaterinburg (RU); Sergei Maximovich Stepin, Ekaterinburg (RU); Alexandr Mikhailovich Nevolin, Berezovsky (RU)

( * ) Notice: Subject to any disclaimer, the term of this patent is extended or adjusted under 35 U.S.C. 154(b) by 779 days.

(21) Appl. No.: 16/321,790

(22) PCT Filed: Jul. 31, 2017

(86) PCT No.: PCT/RU2017/000560
§ 371 (c)(1),
(2) Date: Jan. 30, 2019

(87) PCT Pub. No.: WO2018/026312
PCT Pub. Date: Feb. 8, 2018

(65) Prior Publication Data

US 2021/0278144 A1 Sep. 9, 2021

(30) Foreign Application Priority Data

Aug. 5, 2016 (RU) ..... RU2016132511
Jul. 26, 2017 (RU) ..... RU2017126870

(51) Int. Cl.
*F28F 1/06* (2006.01)
*F28F 1/08* (2006.01)
(Continued)

(52) U.S. Cl.
CPC ..... *F28F 1/06* (2013.01); *F28F 1/08* (2013.01); *F28F 1/426* (2013.01); *F28F 9/22* (2013.01);
(Continued)

(58) Field of Classification Search
CPC .. F28F 1/08; F28F 1/426; F28F 9/0131; F28F 9/0265; F28F 9/22; F28F 2009/226;
(Continued)

(56) References Cited

U.S. PATENT DOCUMENTS 1,436,739 A * 11/1922 Webre ..... B01D 1/26 159/27.2
1,592,845 A * 7/1926 Goodwillie ..... F28B 1/02 165/146
(Continued)

FOREIGN PATENT DOCUMENTS

CN 1078802 11/1993
CN 1297133 5/2001
(Continued)

OTHER PUBLICATIONS

WO-2015107314-A1_English_machine_tranlsation (Year: 2015).*
(Continued)

*Primary Examiner* — Jianying C Atkisson
*Assistant Examiner* — Jose O Class-Quinones

(57) ABSTRACT

A heat exchange apparatus, and more particularly a condenser device, is provided. The condenser includes a housing with tubes that have grooves on the outer surface thereof, baffles, and inlet and outlet manifolds for tube-side and shell-side heat transfer fluids. An outside of each of the tubes is coated with a material having a low wetting coefficient. The baffles of the condenser are formed so, and the that the distance between the baffles decreases from the shell-side heat transfer fluid inlet manifold to the shell-side heat
(Continued)

Figure 1:
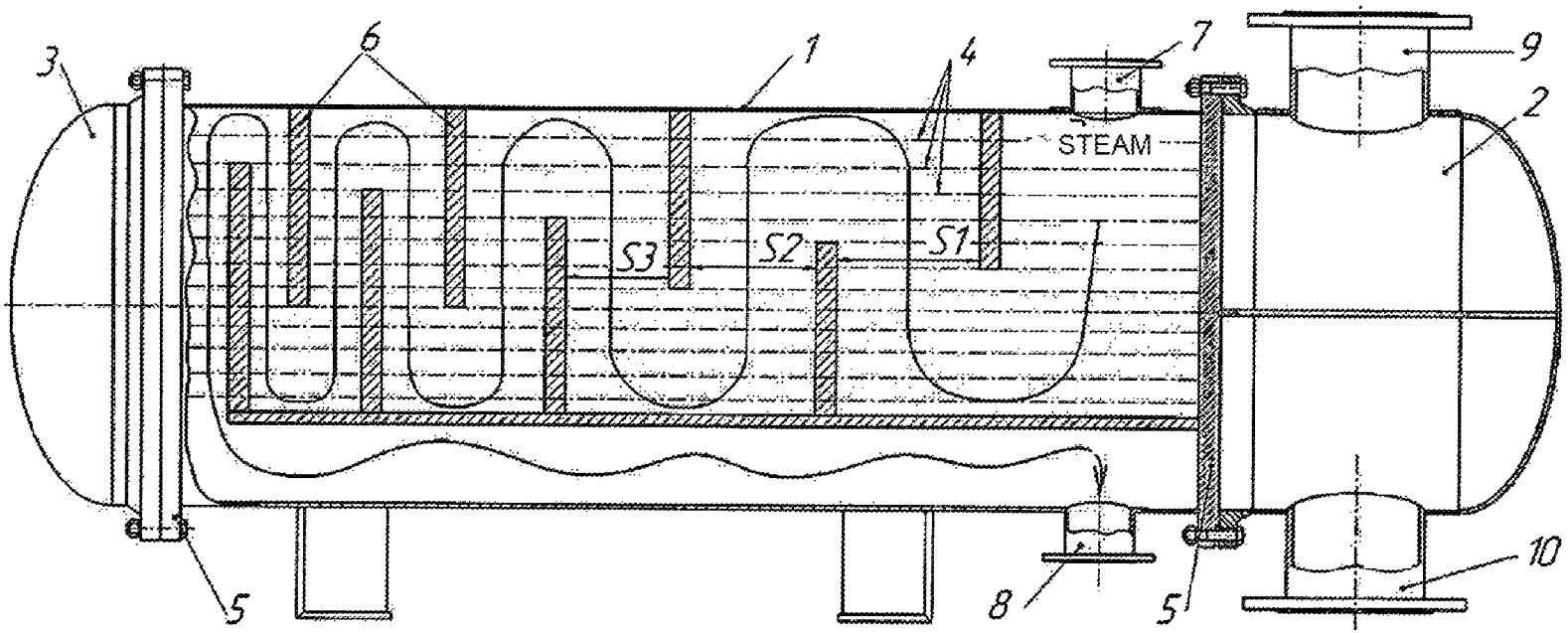

transfer fluid outlet manifold. The inner surfaces of the tubes have protuberances thereon and are coated with a material having a high adhesion resistance coefficient.

12 Claims, 6 Drawing Sheets

(51) Int. Cl.
*F28F 1/42* (2006.01)
*F28F 9/22* (2006.01)
*F28F 13/18* (2006.01)
*F28F 19/02* (2006.01)
*F25B 39/04* (2006.01)

(52) U.S. Cl.
CPC ..... *F28F 13/182* (2013.01); *F28F 19/02* (2013.01); *F25B 39/04* (2013.01); *F25B 2339/046* (2013.01)

(58) Field of Classification Search
CPC ..... F28F 13/04; F28F 2225/04; F28F 13/182; F28F 19/02; F28F 19/04; F28F 19/06; F28F 2245/04; F28F 2245/08; F28F 9/0209; F28F 9/0212; F28F 9/0268; F28F 9/24; F25B 39/04; F25B 2339/046; F28D 7/16; F28D 7/1607; F28D 1/0213; F28D 3/02; F28D 21/0017; F28B 1/02; F28B 1/06; F28B 2001/065; F28B 7/00; F28B 11/00
See application file for complete search history.

(56) References Cited

U.S. PATENT DOCUMENTS 1,773,037 A * 8/1930 Forncrook ..... F28B 1/02 165/146
2,589,730 A * 3/1952 Rathkey ..... F28B 1/02 165/146
3,731,734 A * 5/1973 Ris ..... F28B 11/00 165/110
3,762,468 A * 10/1973 Newson ..... F28F 1/426 165/177
3,779,312 A * 12/1973 Withers, Jr. ..... F28F 1/42 165/184
3,826,304 A * 7/1974 Withers, Jr. ..... F28F 1/42 165/179
3,841,136 A * 10/1974 Withers, Jr. ..... F28F 1/42 72/370.19
4,007,774 A * 2/1977 Withers, Jr. ..... F28F 1/42 165/97
4,102,393 A * 7/1978 Withers, Jr. ..... F28F 1/42 165/174
4,106,449 A * 8/1978 Matsumoto ..... F02M 26/58 123/568.12
4,125,152 A * 11/1978 Kestner ..... C09D 127/18 165/133
4,204,570 A * 5/1980 Eisinger ..... F28D 7/06 122/510
4,332,294 A * 6/1982 Drefahl ..... F28F 1/06 138/173
4,358,046 A * 11/1982 Detz ..... C23C 24/00 148/210
4,577,380 A * 3/1986 Warner ..... F28D 21/001 165/153
4,619,311 A * 10/1986 Vasile ..... F24D 17/0057 165/47
4,776,391 A * 10/1988 Warner ..... B01D 53/507 165/111
4,858,681 A * 8/1989 Sulzberger ..... F17D 5/04 165/70
5,680,772 A * 10/1997 Furukawa ..... F28F 1/426 62/476
5,730,001 A * 3/1998 Furukawa ..... F25B 37/00 62/485
6,346,294 B1 * 2/2002 Reiss ..... C23C 14/021 204/192.16
6,428,863 B1 * 8/2002 Leipertz ..... C23C 14/48 427/255.23
6,660,363 B1 * 12/2003 Barthlott ..... F24S 80/525 428/141
6,684,938 B2 * 2/2004 Tsujita ..... F28D 7/1653 123/568.12
6,942,022 B2 * 9/2005 Blangetti ..... C23C 28/00 165/133
7,327,572 B2 * 2/2008 Erturk ..... F28D 15/043 165/104.33
7,461,639 B2 * 12/2008 Jehlik ..... F28D 7/16 123/568.12
7,985,475 B2 * 7/2011 Dubrow ..... B05D 1/185 428/359
2002/0088611 A1 * 7/2002 Geissler ..... F28D 7/16 165/158
2004/0035561 A1 * 2/2004 Ko ..... F28F 13/04 165/133
2004/0047997 A1 * 3/2004 Keller ..... C09D 1/00 427/402
2004/0224137 A1 * 11/2004 Rogalska ..... G01N 33/5438 428/209
2007/0034170 A1 * 2/2007 Lannes ..... F28F 1/08 122/18.3
2007/0131394 A1 * 6/2007 Schmitz ..... F28F 13/18 165/133
2008/0236803 A1 * 10/2008 Cao ..... F28F 1/422 165/179
2009/0155609 A1 * 6/2009 Gentleman ..... C09D 5/18 428/469
2010/0276122 A1 * 11/2010 Daly ..... F28F 1/426 165/111
2011/0083619 A1 * 4/2011 Master ..... F22B 21/30 122/32
2012/0063560 A1 * 3/2012 Marquino ..... G21C 9/06 376/301
2012/0118722 A1 * 5/2012 Holtzapple ..... F28F 9/0219 203/11
2012/0199534 A1 * 8/2012 Holtzapple ..... B01D 1/26 210/664
2013/0327499 A1 * 12/2013 Goncalves ..... F28F 9/24 165/85
2015/0048526 A1 * 2/2015 Kim ..... B05D 1/185 261/75
2016/0046820 A1 * 2/2016 He ..... B05D 3/002 165/10
2016/0341491 A1 * 11/2016 Duprat ..... F28B 1/02
2017/0176115 A1 * 6/2017 Zhang ..... F28F 13/187

FOREIGN PATENT DOCUMENTS

RU 8459 11/1998
SU 409445 11/1973
WO WO-2015107314 A1 * 7/2015 ..... F28D 7/16

OTHER PUBLICATIONS

English Abstract of CN1078802.
English Abstract of CN1297133.
English Abstract of RU8459.
International Search Report dated Nov. 30, 2017.
Translation of International Search Report dated Nov. 30, 2017.
Written Opinion of International Searching Authority dated Nov. 30, 2017.
Translation of Written Opinion of International Searching Authority dated Nov. 30, 2017.

(56) References Cited

OTHER PUBLICATIONS

International Preliminary Report on Patentability dated Feb. 5, 2019.
English Abstract of SU409445.

* cited by examiner

SHELL AND TUBE CONDENSER AND THE HEAT EXCHANGE TUBE OF A SHELL AND TUBE CONDENSER (VARIANTS)

CROSS-REFERENCE TO RELATED APPLICATION

The instant application is a national phase of PCT International Application No. PCT/RU2017/000560 filed Jul. 31, 2017, and claims priority to Russian Patent Application Serial No. 2017126870 filed Jul. 26, 2017 and Russian Patent Application Serial No. 2016132511 filed Aug. 5, 2016, the entire specifications of all of which are expressly incorporated herein by reference.

This group of inventions relates to shell-and-tube heat-exchanging devices, in particular to shell-and-tube condensers, and can be used in energy, oil processing, oil chemistry, chemical, gas and other industries.

There are many technological solutions relating to heat-exchange devices. Their common feature is a shell that houses a bundle of heat exchange tubes, fixed in place with tube plates, distribution chambers, input and output channels for the shell-side heat carrier, and input and output channels for the tubes. New solutions are suggested all the time, designed to improve these devices, their exploitation properties in particular, including shall-and-tube condensers.

There is a shell-and-tube condenser, wherein heat-exchange tubes are made of polytetrafluorethylene (PTFE) or from metal with PTFE layer sprayed on the surface [CN1078802, priority date 1 Dec. 1971, publication date 24 Nov. 1993;] MPC: F28D7/10, F28D7/10].

There exists a shell-and-tube condenser, which comprises guiding spacers, and along the entire length of the shell, in its lower part, there is a tube with perforations and a rod of appropriate diameter inside the tube [SU409445, priority date 1 Dec. 1971, publication date 30 Nov. 1973; MPC: F28D7/00. F28F9/00].

A shell-and-tube condenser, wherein it includes a shell, containing a bundle of heat-exchange tubes, fixed in place with tube plates located on butt surfaces of the shell, an inlet and an outlet connecting tubes for the tube heat carrier, connecting tubes for the heat carrier inside the tubes, wherein the heat exchange tubes carry grooves on the outer surface [UA74177, priority date 24 Feb. 2012, publication date: 25 Oct. 2012, MPC F28F1/10] was chosen as the prototype for this group of inventions.

A drawback of the prototype is the high level of risk of decreasing heat transfer coefficient between the heat carriers inside the tubes and on the shell side due to the fact that the design of the tubes does not provide for efficient reduction of the condensate film forming on the outer surface, and it also permits formation of crystalline structures of poorly soluble compounds on the inner surface, the low heat conductivity of which considerably increases thermal resistance coefficient and thus impairs efficiency of the shell-and-tube condenser.

The technological problem that this group of inventions targets is increasing the total heat conductivity coefficient between the heat carriers inside the tubes and in the shell space.

The technological result that this group of inventions strives to achieve is decreasing the risk of increased thermal resistance between the heat carriers inside the tubes and in the shell space of shell-and-tube condensers.

The substance of the shell-and-tube condenser in the first version is as follows.

A shell-and-tube condenser includes a shell, which contains a bundle of heat exchange tubes carrying grooves on the outer surface and fixed in place with tube plates, guiding spacers, and input and output of the heat carrier of the shell space, and inlet and outlet for the heat carrier inside the tubes. Unlike in the case of the prototype, the outer surface of the heat exchange tubes is covered with a material with a hydrophobic coefficient, while the distance between the guiding spacers decreases from the inlet to the outlet of the shell space heat carrier.

The substance of the shell-and-tube condenser in the second version is as follows.

The shell-and-tube condenser includes a shell which houses a bundle of tubes with grooves on the outer surface, fixed in place with tube plates, guiding spacers, inlet and outlet for the heat carrier in the tubes and inlet and outlet for the heat carrier in the shell space. Unlike in the case of the prototype, the outer surface of the heat exchange tubes is coated with hydrophobic material. The tubes carry ribs on their inner surface, which is coated with low adhesion resistance material, and the distance between the guiding spacers decreases from the inlet of the shell space heat carrier to its outlet.

The substance of the heat exchange tube of the shell-and-tube condenser in the first version is as follows.

The heat exchange tubes of the shell-and-tube condenser carry grooves on the outer surface. Unlike in the case of the prototype, the outer surface of the tubes is coated with a hydrophobic material, while on the inner surface, which is coated with a high adhesion resistance material, it carries ribs.

The substance of the heat exchange tube of the shell-and-tube condenser in accordance with the second version is as follows.

The heat exchange tube of the shell-and-tube condenser carries groove on the outer surface. Unlike the prototype, its outer surface is coated with a hydrophobic coefficient material, while its inner surface is coated with a high adhesion resistance coefficient and caries ribs.

The hydrophobic material ensures a water-repelling coating, thanks to which the condensate rolls off the outer surface. The hydrophobic material can be characterised by an interfacial angle. The interfacial angle in the 90°-150° ensures highest water-repelling characteristics of the outer surface of the heat exchange tube. Materials of this quality include synthetic polyamides or polymers, nylon, Teflon™, or polytetrafluorethylene.

The shortening space between the guiding spacers ensures that the heat carrier moves along the shell space with a permanent, optimal velocity, within the 65-120 m/sec. The heat carrier in the shell space, introduced to the condenser—via the inlet—in the form of steam, condenses while moving from the inlet to the outlet and from run to another. As fluid has a smaller volume than steam, the total volume of heat carrier in the shell space decreases, so that as steam continues to spread in the shell space, pressure during further runs of the system drops, and, in the end, steam velocity also decreases. Due to this main principle of the shortening distance between the guiding spacers average velocity of the steam is maintained constant for the duration of each pass of the heat carrier in the shell space. Consequently, the pass of the heat carrier in this case is the distance between two adjacent guiding spacers where steam moves along a straight line, normally to the tubes. Constant average velocity of the steam for each pass of the shell space heat carrier is ensured by a constant ratio of the average volumetric steam discharge during every pass of the heat carrier in the shell space to the sectional area of a particular pass of the heat carrier in the shell space.

That ratio is calculated with the following formula.

$$\begin{cases} \frac{D_1' + D_1''}{2F_1} = \frac{D_2' + D_2''}{2F_2} = \frac{D_{n-1}' + D_{n-1}''}{2F_n} = \cdots = \frac{D_n'}{F_n} \\ \sum_{i=1}^{n} (D_i' - D_i'') = D_{total} \\ \sum_{i=1}^{n} F_i = F \end{cases}$$

Where:

D'I is volumetric discharge of steam at the start of pass 1 of the shell space, $m^3/h$ D"I is a volumetric discharge of steam at the end of pass 1 of the shell space, $m^3/h$ Fi is a sectional area of a pass of the heat carrier in the shell space $m^2$ F is the total Sectional area of all passes, $m^2$ N is the total number of passes.

An extra means for maintaining constant velocity of the heat carrier in the shell space, especially in turning areas, that can be used is decreasing the area of the window between consecutive guiding spacers in comparison with the preceding ones.

The heat exchange tube of the shell-and-tube condenser carries grooves on its outer surface, which provides for the creation of sloping areas. This reduces the thickness of the condensate film that forms on the outer surface of the heat exchange tube, or keeps breaking it. The grooves can be of different shape and can be directed differently; they can form circular, helical, or polyhedral depressions. They can be produced by cutting, shearing, knurling or punching. Optimal sizes of the grooves may be like following: grooves might have roundings with the radius measuring 0.04-0.1 of the outer diameter of the heat exchange tube, while the radius of roundings of the sloping areas of the outer surface may measure 0.3-2 of the outer diameter of the heat exchange tube. The depth of grooves can be 0.1-3 mm, while the distance between any two adjacent grooves may depend on the outer diameter of the heat exchange tube; it can be greater or smaller than the diameter of the heat exchange tube; however, it must not exceed the diameter of heat exchange tubes by more than 10-fold.

Materials with a high adhesion resistance ensures that a coating with a low coefficient of friction forms on the inner surface of the heat exchange tubes, which prevents adhesion and deposition of salts and other impurities present in heat carrier inside the tubes. Materials with high adhesion resistance can include synthetic polyamides, polymers or fluorine-containing materials, Teflon™, polytetrafluorethylene or different metallic sprays. These materials can also be applied as a coating in combination with one another on the inner surface of the tubes: a metallic spray can become the bottom layer, while a fluorine-containing material would become the top layer. Polytetrafluorethylene or Teflon™ permit application of a very thin coating (starting at 0.1 micron), preventing additional growth of thermal resistance between the heat carriers in the tubes and in the shell space.

The heat exchange tube made in accordance with the second version carries ribs on the inner surface, promoting formation of turbulent eddies, which break the laminar flow of the heat carrier inside the tubes, thus reducing the probability of salt and other impurities deposition on the inner surface of heat exchanger tubes. Turbulent eddies also promote abrasive interaction between the salts and other impurities on the crystalline structures of poorly soluble compounds, already formed on the inner surface of the tubes, that helps to clean tubes from existing deposits.

Ribs can be of different shape: circular, diamond-shape, rectangular etc. Ribs can be positioned at assigned points, be of assigned height, which would depend on diameter and thickness of the walls of the tubes, flow velocity and properties of the heat carrier in the tubes and on presence of salts and other impurities in them. To reduce the risk of salt deposition between ribs and, consequently, reduce the risk of increasing thermal resistance between the heat carriers inside the tubes and in the shell space, the ribs can be spaced at regular intervals, 01-10 external diameters of the heat exchange tube between them. The height of the ribs can measure 0.1-10 mm. The width of the ribs can measure 0.5-10 mm.

Circular ribs can be made by milling, knurling or shearing. Diamond-shape ribs can be produced by either cutting or punching criss-cross helical grooves on the inner surface of the tubes, while rectangular ribs can be made by cutting or punching criss-crossing straight-line longitudinal and transverse grooves on the inner surface of tubes.

Ribs can also be fabricated by inserts set inside the tube and/or fastened to its inner surface. They can have a shape of ribs, helical bands, rings or corrugated components. To fortify eddies in the heat carrier flow inside the tubes, the inserts can be perforated through, while their surface can be coated with a high adhesion resistance material.

Ribs on the inner surface of a heat exchange tube can be fabricated as counterparts of the grooves on the outside surface. For instance ribs on the inner surface of a tube can be fabricated in the process of knurling the grooves on the outer surface of that tube, which imparts some extra reliability and simplifies the manufacturing of heat exchange tubes.

This group of inventions offers a combination of new, substantial features, unknown to the present state of technology. These features are:

- the distance between the guiding spacers of the shell-and-tube condenser decreases from the inlet to outlet of the shell space heat carrier, ensuring permanent velocity of the heat carrier in the shell space, which provides for efficient removal of condensate drops from the outer surface of heat exchange tubes by a flow of non-condensed heat carrier throughout the entire shell space.
- the outer surface of heat exchange tubes is coated with a hydrophobic material, which reduces adhesion of condensate drops to the outer surface of heat exchange tubes.
- the inner surface of the heat exchange tubes is coated with a material with a high adhesion resistance coefficient, which reduces molecular interaction between particles of salt and the inner surface of the tubes, hindering formation of crystalline deposits of poorly soluble compounds on the inner surface of the heat exchange tubes.
- heat exchange tubes carry ribs on their inner surface, which generate eddies in the heat carrier flow inside the tubes, which break crystalline deposits on the surface of heat exchange tubes.

This combination of specific characteristics of this group of inventions ensures effective removal of condensate drops from the outer surface of heat exchange tubes, reduce adhesion of condensate drops at the outer surface of the tubes, hindering formation of crystalline deposits of poorly soluble compounds on the inner surface of the tubes or breaking those such deposits that have already formed, which ensures that the desired technological result is achieved: the risk of growing thermal resistance between the heat carriers inside the tubes and in the shell space is reduced, while the heat transfer coefficient between the said heat carriers is amplified.

The said new substantial characteristics suggest that this invention meets the "novelty" patentability criterion.

These characteristics of the proposed group of inventions are known, described in various science and technology publications, however, they usually aim at a different technological result, such as improving wear resistance of heat exchange tubes (polytetrafluorethylene coating) or extending the duration of contact between heat carriers inside the tubes and in the shell space. Moreover, the combination of the said characteristics with one another is not known from the state of art, also their combination with the presence of grooves on the outer surface and of ribs on the inner surfaces of heat exchange tubes is also unknown. The design of a device that includes coating of heat exchange tubes with a hydrophobic material, grooves and ribs on the surfaces of heat exchange tubes and the gradually decreasing distance between guiding spacers achieve a synergic effect: a significantly increased heat transfer coefficient between the heat carriers inside and outside the tubes of the shell-and-tube condenser, including due to the reduced thermal resistance coefficient between the heat carriers inside and outside the tubes.

This synergic effect is achieved due to the fact that the heat carrier in the shell space, condensed during the heat exchange process, forms only a very thin film on the outer surfaces of the heat exchange tubes covered with a hydrophobic material; consequently it forms droplets, most of which roll down from arcuate areas of the tubes into circular grooves, while those drops that stay on the arcuate surfaces of the tubes are carried away by the heat carrier flow in the shell space. Velocity of the flow is maintained due to the distance between the guiding spacers decreasing from the inlet of the shell space heat carrier to its outlet. Particles of salt in the heat carrier inside the tubes are repelled by the inner surface of the tubes, which is coated with a high adhesion resistance material. They interact with ribs, forming eddies, which have an abrasive effect on previously formed salt deposits, breaking them very efficiently.

To illustrate the synergic effect achieved, effects of application of one or another characteristic separately or combined were analysed. It is known from available information that grooves on heat exchanger tubes increase heat transfer coefficient by 1.5-1.9 times, that having heat transfer tubes coated with hydrophobic material increases that coefficient by 2.6-3.2 times, that gradually decreasing the distance between the guiding spacers increases it by 1.1-1.2 times, having heat transfer tubes coated inside with a high adhesion resistance material, by 1.8-2.4 times (depending on exploitation time), presence of ribs increase it by 1.4-1.6 times. In practice, application of this group of inventions increases heat transfer coefficient by 6.2-13.4 times. This result exceeds by several times the forecast total effect of combined application of the said characteristics calculated on the basis of the above theoretical data. This confirms that a synergic effect can be achieved.

This group of inventions is illustrated with the following diagrams.

FIG. 1. The shell-and-tube condenser with a one-way feed of a heat carrier into the shell, and a condensate cooler. Overall view. Longitudinal section.

Figure 2:
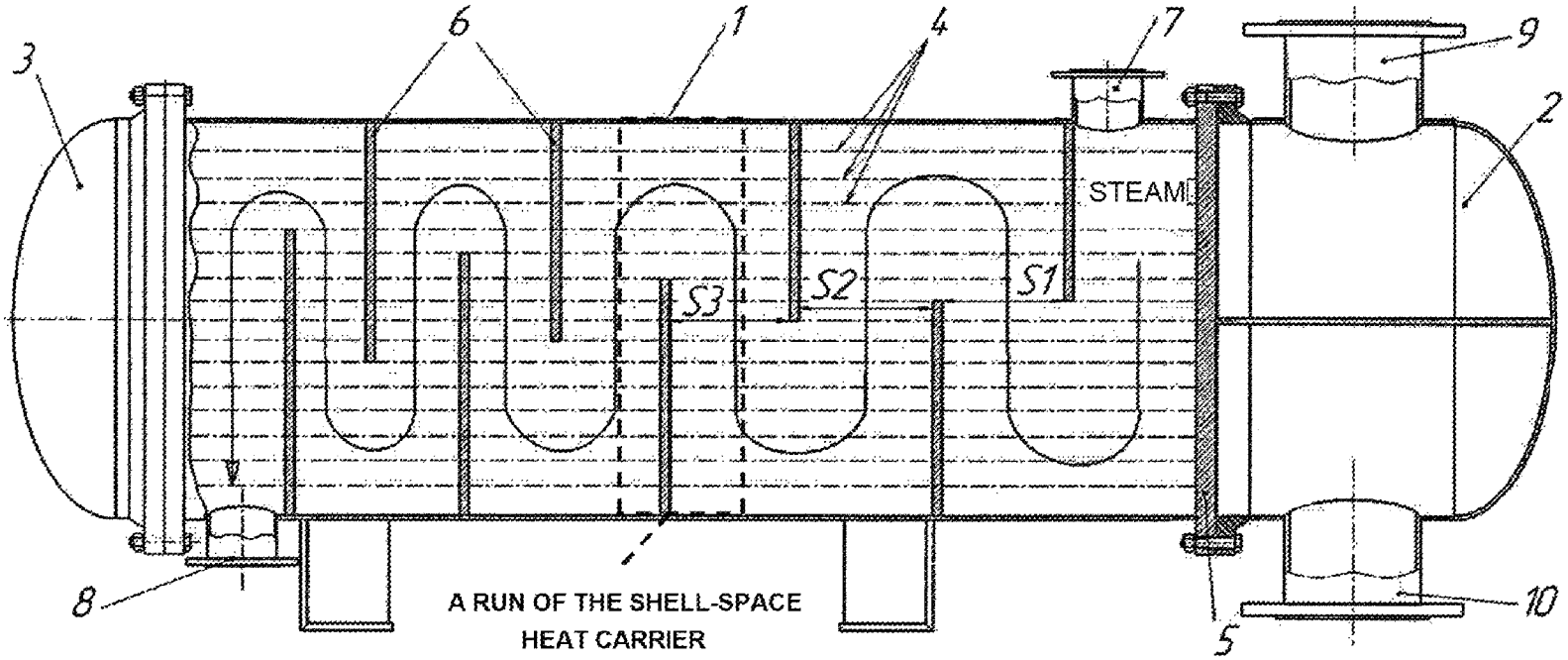

FIG. 2. The shell-and-tube condenser with a one-way flow of a heat carrier in the shell space without a condensate cooler. Overall view. Longitudinal section.

Figure 3:
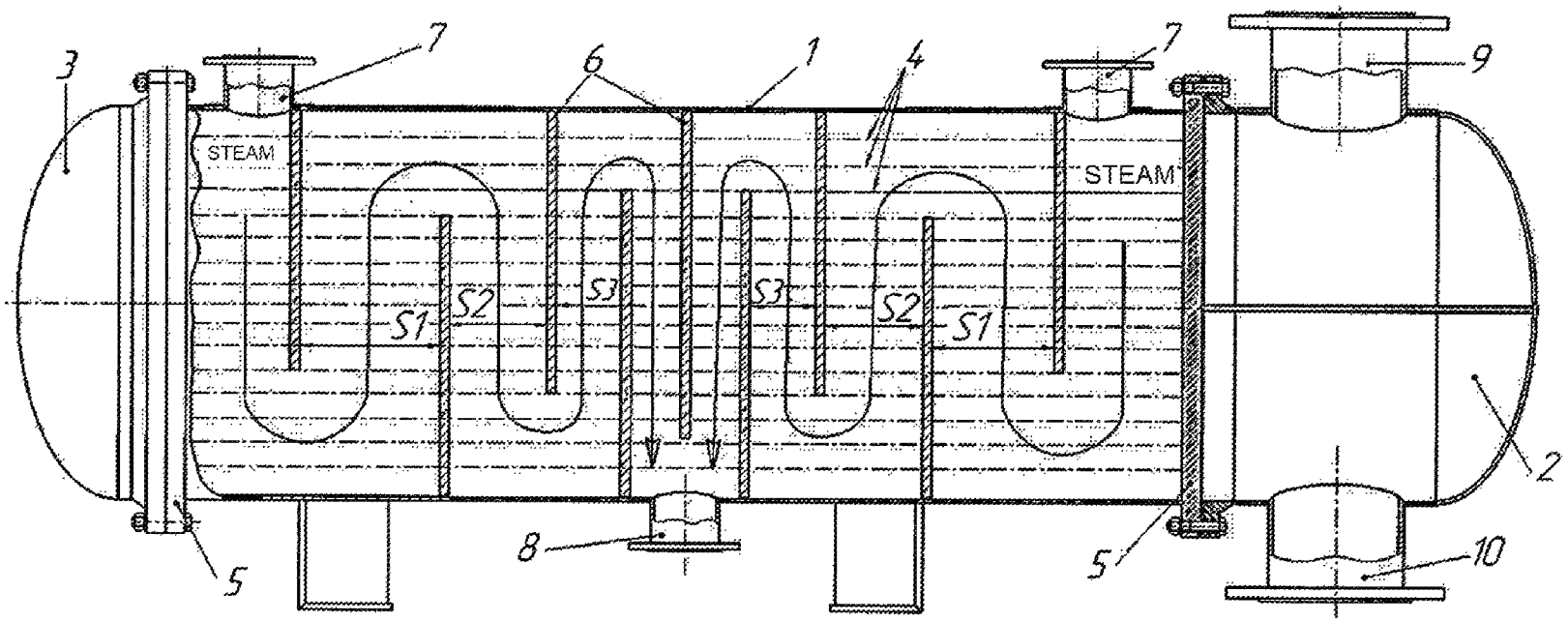

FIG. 3. The shell-and-tube condenser with a two-way feed of a heat carrier in the shell without a condensate cooler. Overall view. Longitudinal section.

Figure 4:
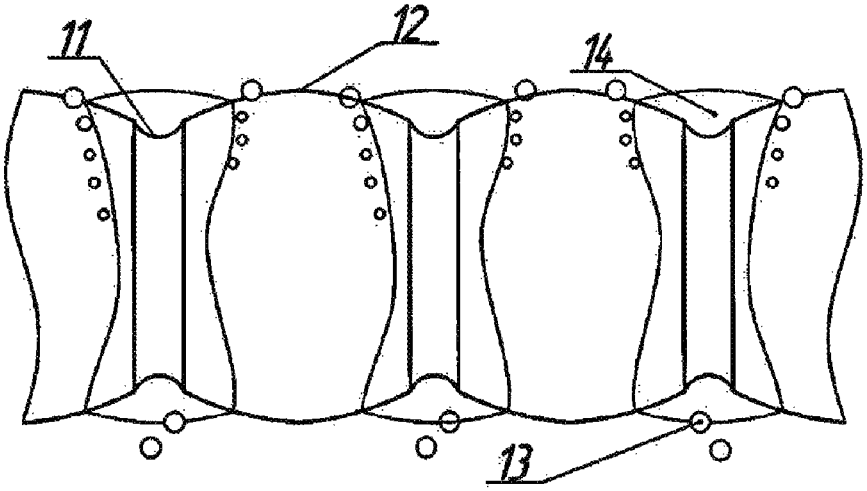

FIG. 4. A heat exchange tube of the shell-and-tube condenser with circular grooves on the outer surface. Overall view.

Figure 5:
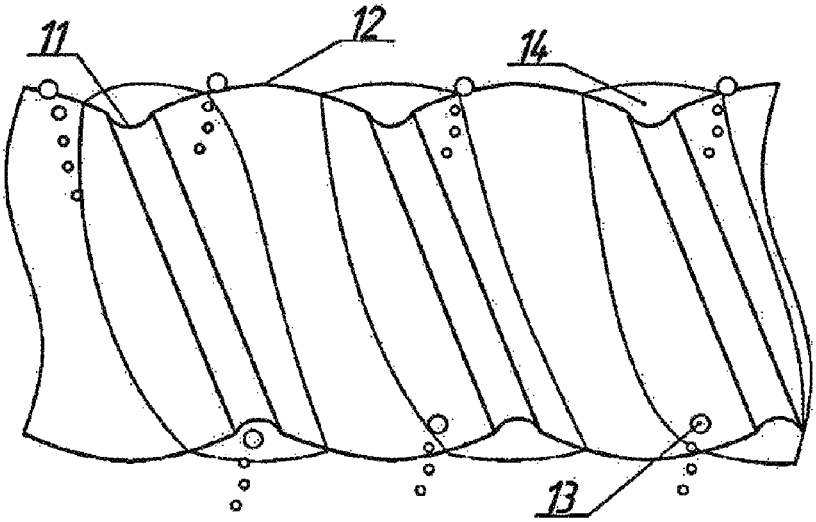

FIG. 5. A heat exchange tube of the shell-and-tube condenser with helical grooves on the outer surface. Overall view.

Figure 6:
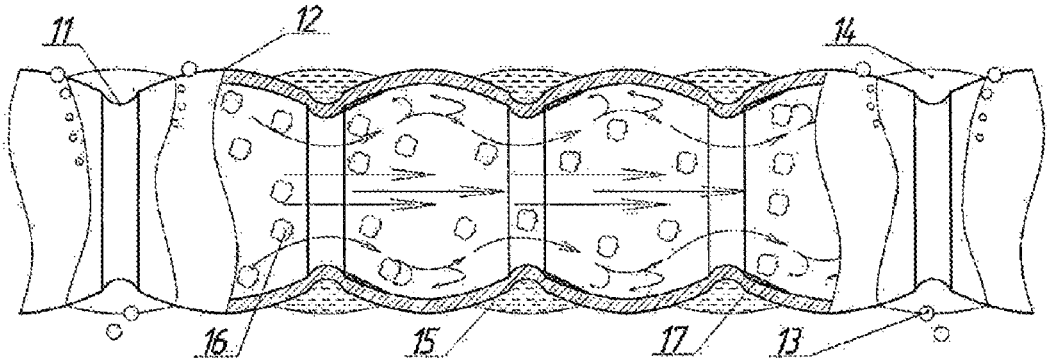

FIG. 6. A heat exchange tube of the shell-and-tube condenser with circular grooves on the outer surface and corresponding circular ribs on the inner surface. Longitudinal section.

Figure 7:
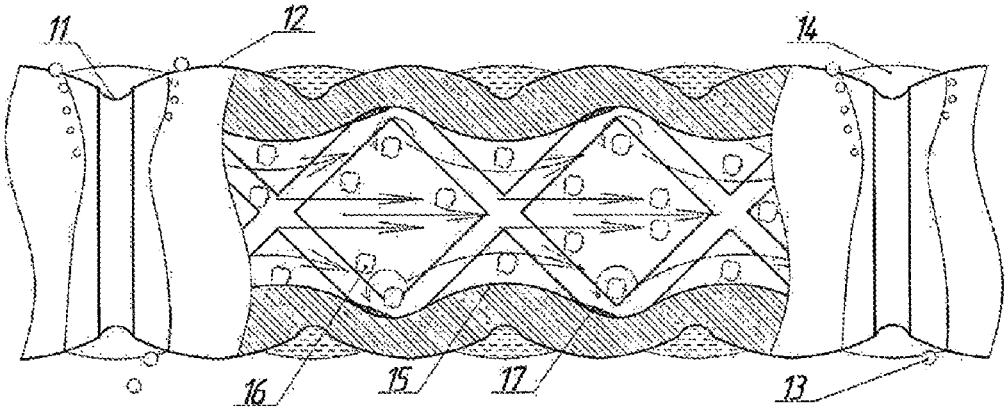

FIG. 7. A heat exchange tube of the shell-and-tube condenser with circular grooves on the outer surface and diamond-shape ribs on the inner surface. Longitudinal section.

Figure 8:
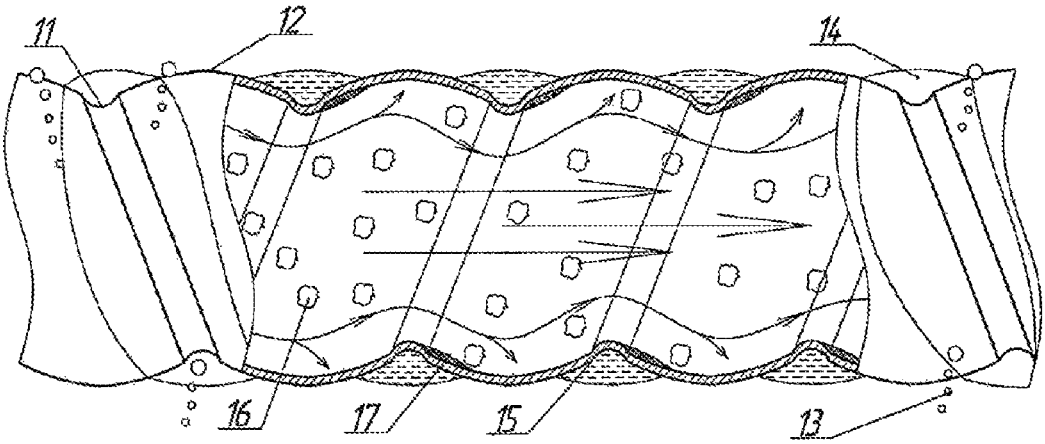

FIG. 8. A heat exchange tube of the shell-and-tube condenser with a helical groove on the outer surface and a corresponding diamond-shape ribs on the inner surface. Longitudinal section.

Figure 9:
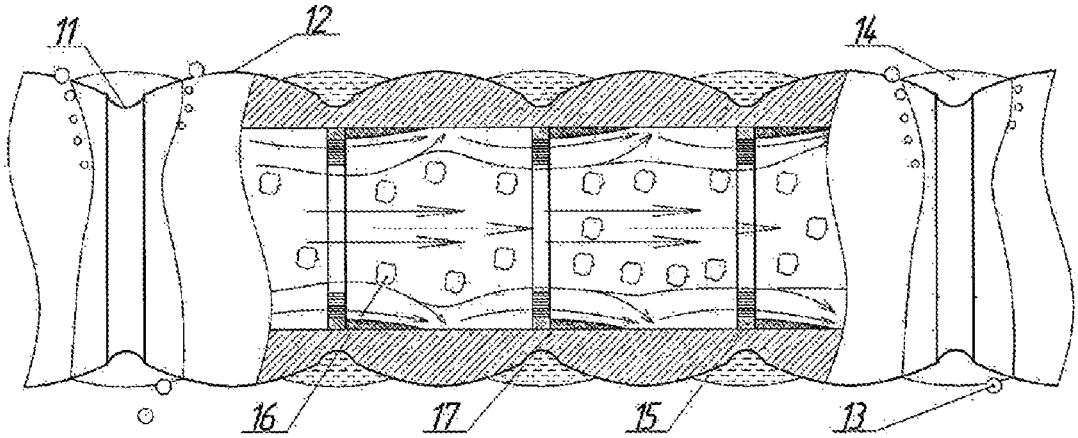

FIG. 9. A heat exchange tube of the shell-and-tube condenser with circular grooves on the outer surface and inserts in the shape of perforated rings. Longitudinal section.

The shell-and-tube condenser includes shell 1, distribution chamber 2 and turn chamber 3. Shell 1 houses a bundle of heat exchange tubes 4, fastened in place with tube plates 5, guiding spacers 6, shell side heat carrier inlet 7, outlet 8, tube-inside heat carrier inlet 9, outlet 10. The distance Sn between the spacers 6 decreases from inlet 7 to outlet 8, so that Sn>Sn+1. Heat exchange tubes 4 are coated with a hydrophobic material and carry grooves 11, due to which arcuate convex sections 12 form on the outer surface 4 of the tubes.

Shell-and-tube condenser operates as follows.

A coolant at a temperature below the steam saturation temperature is fed into the tubes at the temperature below the steam saturation temperature in the shell space 1 via inlet 9. The coolant circulates from inlet 9 to the distribution chamber 2, then, via heat exchange tubes 4 and the turn chamber 3 back to the distribution chamber 2 and outlet 10. The heat carrier in the shell space, that is to be cooled down, enters the shell space 1 via inlet 7. Coming into contact with the outer surface of tubes 4, it begins to partly condensate, flowing towards outlet 8. Droplets 13 of condensate form on the outer surface of the heat exchange tubes, most of which roll off arcuate segments 12 down into grooves 11. Residual condensate 14 is carried away by the flow of uncondensed shell space heat carrier, velocity of which is maintained by gradually decreasing the distance between the consecutive spacers 6 from inlet 7 of the shell space heat carrier to its outlet 8.

According the second version, tubes 4 of the shell-and-tube condenser carry—in addition to the first version—ribs 15; also the inner surface of the tubes is coated with a high adhesion resistance material.

This shell-and-tube condenser operates in a manner similar to the first version. Only a small quantity of salt particles 16 present in the coolant precipitates on the inner surface of tubes 4 thanks to the coat of a high adhesion resistance material on these surfaces, forming only the thin layer 17 of salt deposit. The coolant, interacting with ribs 15, generates eddies, which also impede deposition of salt 16 on the inner surface of the heat exchange tubes and breaks the previously formed layer 17 of salt by abrasion caused by the flow of the coolant and particles of salt 16 present in the coolant.

Thanks to the above arrangements, the film of condensate that forms on the outer surface of heat exchange tubes is thin and, on the other hand, fewer salt deposits form on the inner surface of the tubes. This achieves the desired technological result: cutting down the risk of increased thermal resistance between the heat carriers inside and outside the tubes, while increasing the overall heat exchange coefficient between the heat carriers in the tubes and in the shell space. Due to the decreased contact surface required, tube bank can be made smaller and of lighter weight, rendering the entire shell-and-tube condenser smaller and of lighter weight.

The invention claimed is:

1. A shell-and-tube condenser, comprising:

a shell, which houses a bundle of heat exchange tubes having grooves on their outer surfaces and fastened in place with tube plates, spacers, and inlets and outlets for tube space and shell space heat carriers;

wherein the outer surfaces of the heat exchange tubes include a coating of a hydrophobic material, a distance between the spacers decreases from the inlet of the shell space heat carrier to its outlet and, a length of each of the spacers increases from the inlet of the shell space heat carrier to its outlet;

the heat exchange tubes include ribs on inner surfaces thereof and a coating on the inner surfaces of a material with a high adhesion resistance coefficient.

2. The shell-and-tube condenser according to claim 1, wherein the distance between the spacers decreases so as to maintain constant average velocity of steam during every pass of the shell space heat carrier.

3. The shell-and-tube condenser according to claim 1, wherein the distance between the spacers decreases so as to maintain a constant ratio between an average volumetric flow rate of steam for every pass of the shell space heat carrier and a sectional area of an appropriate pass of the shell space heat carrier.

4. The shell-and-tube condenser according to claim 1, wherein the hydrophobic material is selected from the group consisting of nylon, polytetrafluorethylene and combinations thereof.

5. The shell-and-tube condenser according to claim 1, wherein the hydrophobic material which coats the outer surfaces of the heat exchange tubes has an interfacial angle in a range of 90°-150°.

6. The shell-and-tube condenser according to claim 1, wherein the grooves have a rounding with a radius of 0.04-0.1 of an outer diameter of the heat exchange tubes.

7. The shell-and-tube condenser according to claim 1, wherein a radius of a rounding of a sloping area on a surface between the grooves measures 0.3-2 of the outer diameter of the heat exchange tubes.

8. The shell-and-tube condenser according to claim 1, wherein the material with high the adhesion resistance coefficient comprises fluorine-containing material or sprayed metal.

9. The shell-and-tube condenser according to claim 1, wherein the ribs formed on the inner surfaces of the heat exchange tubes correspond to the grooves on the outer surface of the heat exchange tubes.

10. The shell-and-tube condenser according to claim 9, wherein the ribs and grooves are circular in shape.

11. The shell-and-tube condenser according to claim 9, wherein the ribs and groves are located at 0.1-10 times an outer diameter of the heat exchange tubes from one another.

12. The shell-and-tube condenser according to claim 9, wherein a height of the ribs is in a range of 0.5-10 mm.

* * * * *